US007845320B2

(12) United States Patent
Allen

(10) Patent No.: US 7,845,320 B2
(45) Date of Patent: Dec. 7, 2010

(54) ADJUSTABLE CAMSHAFT SPROCKET ASSEMBLY AND TOOL FOR SAME

(75) Inventor: Timothy R. Allen, Palm Coast, FL (US)

(73) Assignee: Cloyes Gear and Products, Inc., Fort Smith, AK (US)

( * ) Notice: Subject to any disclaimer, the term of this patent is extended or adjusted under 35 U.S.C. 154(b) by 703 days.

(21) Appl. No.: 11/811,187

(22) Filed: Jun. 8, 2007

(65) Prior Publication Data

US 2008/0047514 A1 Feb. 28, 2008

Related U.S. Application Data

(60) Provisional application No. 60/812,508, filed on Jun. 9, 2006.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 3,128,653 A * 4/1964 Service et al. ..... 72/56
5,174,169 A 12/1992 Allen
5,495,776 A 3/1996 Allen
5,645,024 A 7/1997 Allen et al.
6,532,923 B2 * 3/2003 Woodward et al. ..... 123/90.17
6,532,932 B1 3/2003 Strauss

OTHER PUBLICATIONS

"SA Gear Adjustable Timing Chain Set" as shown in CNC-Motorsports.com website print-outs, pp. 1-2, (Product Introduction Date believed to be in 2003 or before).

* cited by examiner

*Primary Examiner*—Ching Chang
(74) *Attorney, Agent, or Firm*—Fay Sharpe LLP

(57) ABSTRACT

An adjustable camshaft sprocket assembly includes a hub and a sprocket body secured to the hub. A stud-receiving opening is defined in one of the hub flange and the sprocket body, and a tool-receiving opening is defined in the other of the hub flange and the sprocket body. The tool-receiving opening is aligned with the stud-receiving opening is adapted to receive a body portion of an adjustment tool, and the stud-receiving opening is adapted to receive an eccentric stud of the adjustment tool. Either the stud-receiving opening or the tool-receiving opening is elongated. Rotation of the adjustment tool when its body is located in the tool-receiving opening and its eccentric stud is located in the stud-receiving opening causes relative angular movement between the hub and the sprocket body. One or more fasteners are used to immovably secure the sprocket body to the hub after adjustment. A tool includes cylindrical base, a driving head, and an eccentric stud. The stud comprises a spring pin press-fit into a bore.

15 Claims, 5 Drawing Sheets

ADJUSTABLE CAMSHAFT SPROCKET ASSEMBLY AND TOOL FOR SAME

CROSS-REFERENCE TO RELATED APPLICATION

This application claims priority from and benefit of the filing date of U.S. Provisional Application Ser. No. 60/812,508 filed Jun. 9, 2006, and the disclosure of said provisional application Ser. No. 60/812,508 is hereby expressly incorporated by reference into the present specification.

BACKGROUND

Adjustable camshaft sprocket assemblies for internal combustion engines are well known and in widespread use. In general, the camshaft includes a camshaft sprocket assembly connected thereto that is driven by a chain or belt that is also engaged with a drive sprocket such as a crankshaft sprocket. The adjustable camshaft sprocket assembly allows for selective adjustment of the relative angular position between the camshaft sprocket and the camshaft to effect a corresponding timing adjustment of the intake and exhaust valves driven by the camshaft. Examples of such adjustable camshaft sprocket assemblies are disclosed in U.S. Pat. Nos. 6,532,923 and 5,174,169 and 5,495,776, all of which are hereby expressly incorporated by reference into the present specification.

In one common arrangement, the adjustable camshaft sprocket assembly is covered by a timing chain cover assembly that includes a main cover defining an access opening that is closed by a cap or lid. The lid of the timing chain cover assembly is removed as needed to provide access to the underlying camshaft sprocket assembly. U.S. Pat. No. 5,645,024 discloses an example of a timing chain cover of the type just described, and this patent is also hereby expressly incorporated by reference into the present specification.

It has been deemed desirable to provide a new and improved adjustable camshaft sprocket assembly that is also usable with a timing chain cover assembly such as disclosed in U.S. Pat. No. 5,645,024, wherein the angular position of the sprocket relative to the camshaft can be adjusted through the access opening of the timing chain cover assembly by removal of the lid, and without requiring the main timing chain cover to be removed. Also, it has been deemed desirable to provide an adjustable camshaft sprocket and tool for same, wherein the tool is simple and inexpensive to manufacture as compared to known designs, and wherein the adjustable camshaft sprocket assembly is simplified in construction and exhibits better overall performance.

SUMMARY

In accordance with one aspect of the present invention, an adjustable camshaft sprocket assembly includes a hub adapted to be secured to an associated camshaft, the hub comprising a flange. A sprocket body is selectively engaged with the hub flange using at least one fastener, wherein said sprocket body is selectively angularly adjustable relative to the hub flange when the fastener is loosened and the sprocket body is angularly fixed relative to the hub flange when the fastener is tightened. A stud-receiving opening is defined in one of the hub flange and the sprocket body, and a tool-receiving opening is defined in the other of the hub flange and the sprocket body. The tool-receiving opening is aligned with the stud-receiving opening and is adapted to receive a body portion of an associated adjustment tool, and the stud-receiving opening is adapted to receive an eccentric stud of the associated adjustment tool, wherein either the stud-receiving opening or the tool-receiving opening is elongated to allow relative sliding movement of the associated adjustment tool therein, wherein rotation of the associated adjustment tool when its body is located in the tool-receiving opening and its eccentric stud is located in the stud-receiving opening causes relative angular movement between the hub and the sprocket body when the fastener is loosened.

In accordance with another aspect of the present development, an adjustable camshaft sprocket assembly includes a sprocket body adapted to be mounted to an associated camshaft. A mounting plate is adapted to be non-rotatably mounted on the associated camshaft and abutted with the sprocket. At least one fastener is selectively threadably advanced into a mating bore of the associated camshaft from a loosened position to a tightened position, wherein: (i) the fastener clamps the mounting plate and sprocket body to the associated camshaft when in said the tightened position to prevent rotation of the sprocket body relative to the associated camshaft; and, (ii) an angular position of the mounting plate relative to the sprocket body is adjustable when the at least one fastener is in said loosened position. An adjustment tool opening is defined in the mounting plate, and a stud-receiving bore is defined in the sprocket body and accessible through the adjustment tool opening. The adjustment tool opening is adapted to receive a body of an associated adjustment tool and the stud-receiving bore is adapted to receive a projecting eccentric stud of the associated adjustment tool, such that rotation of the associated adjustment tool in the adjustment tool opening causes relative angular movement between the mounting plate and the sprocket body when the fastener is in said loosened position.

In accordance with another aspect of the present invention, a tool for adjusting a camshaft sprocket assembly includes cylindrical base defined about a central axis and a driving head connected to the base. A stud projects axially outward from the cylindrical base. The stud is eccentrically located relative to the central axis. The stud comprises a spring pin press-fit into an eccentric bore defined in the cylindrical base.

In accordance with another aspect of the present invention, an adjustable camshaft sprocket assembly includes hub adapted to be secured to an associated camshaft, the hub including a flange. A sprocket body is secured to the hub flange using at least one fastener. The sprocket body is selectively angularly adjustable relative to the hub flange when the at least one fastener is loosened. The sprocket body is immovably fixed to the hub flange when the at least one fastener is tightened. A stud-receiving slot is defined in the hub flange and is adapted to receive a projecting eccentric stud of an associated adjustment tool. A tool-receiving opening is defined in the sprocket body and aligned with the stud-receiving slot and is adapted to receive a body portion of the associated adjustment tool. Rotation of the associated adjustment tool body in the tool-receiving opening with the associated adjustment tool eccentric stud located in the stud-receiving slot causes relative angular movement between the hub and the sprocket body when the at least one fastener is loosened.

DETAILED DESCRIPTION

Figure 1:
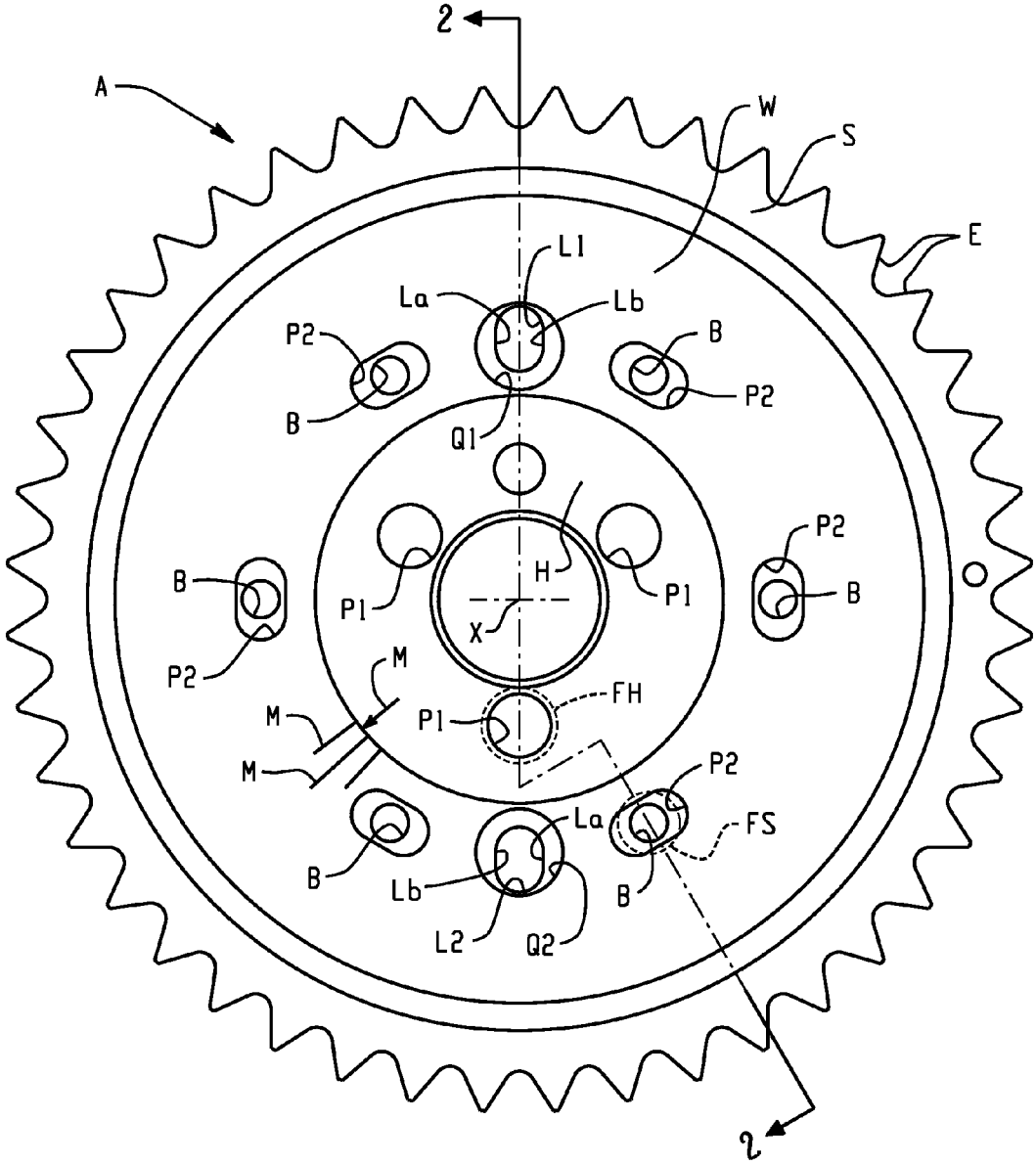
FIG. 1 is a front view of an adjustable sprocket assembly formed in accordance with the present invention.

FIG. 1 is a front view of an adjustable sprocket assembly A formed in accordance with the present invention. The sprocket assembly comprises a steel or other metal hub H and a steel or other metal sprocket body S connected to the hub H. The sprocket body S comprises a plurality of teeth E that are engaged by an associated drive chain or belt (not shown) that is driven by a drive sprocket (not shown), e.g., a crankshaft sprocket. The sprocket body S is fixedly secured to the hub H so that rotation of the sprocket body causes rotation of the hub and, consequently, rotation of a camshaft CS (see FIG. 2) connected to the hub H. As shown, the hub H comprises a plurality of apertures P1 that receive bolts or other fasteners FH (only one shown) used to secure the hub H to the camshaft CS. Alternatively, the sprocket body S and teeth E can be provided as a gear body including gear teeth engaged with another gear that drives the gear body and, thus, the hub.

The hub H comprises a radially enlarged flange HF to which the sprocket body S is adjustably secured. A plurality of tapped bores B are defined in the flange HF. The sprocket body S comprises a central web W that defines a corresponding plurality of elongated apertures or slots P2 that are respectively registered with the tapped bores B of the hub flange HF. Bolts or other sprocket fasteners FS (only one shown) are respectively inserted into each elongated aperture P2 and threaded into the aligned tapped bore B of the hub flange HF to clamp the sprocket body S immovably to the hub flange HF so that the sprocket body S is able to drive the hub H and camshaft CS rotationally as described. Alternatively, a single bolt is used to fixedly secure the sprocket body S to the hub H. Furthermore, a fuel pump eccentric drive member or other structures can additionally be connected to the hub H to rotate therewith.

The hub H further comprises at least one radially extending/elongated stud-receiving adjustment opening L1 (as shown, first and second diametrically opposed adjustment openings L1,L2 are provided). In the illustrated embodiment, each adjustment slot L1,L2 is elongated or ovalized along a radial axis originating at the axis of rotation X of the sprocket assembly A so as to define a slot, and comprises first and second opposite lateral sides La,Lb. The web W of the sprocket body S comprises at least one and, as shown herein, first and second circular tool-receiving openings or apertures Q1,Q2 that respectively overlie and surround the slots L1,L2, so that the slots L1,L2 are accessible through the tool-receiving apertures Q1,Q2. In the case where multiple slots L1,L2 and corresponding tool-receiving locations Q1,Q2 are provided, as shown herein, it is preferred that these be symmetrically distributed about the hub flange HF and sprocket web W so as not to unbalance the sprocket assembly A. Alternatively, the stud-receiving/adjustment openings L1,L2 are defined in the sprocket body web W and the tool-receiving openings are defined in the hub H.

As described in full detail below, the hub H and camshaft CS are selectively rotated relative to the sprocket body S to perform camshaft timing adjustment by:

(i) loosening the sprocket fasteners FS connecting the sprocket body S to the hub H to allow relative angular movement therebetween;

(ii) inserting a tool T (FIGS. 3, 4, 5) into a tool-receiving aperture Q1,Q2 with a projecting stud of the tool T is inserted in the corresponding stud-receiving adjustment slot L1,L2;

(iii) using a wrench or other driver to rotate the tool T which, in turn, causes rotation of the hub H relative to the sprocket body S about the axis of rotation X (and/or vice versa in some cases);

(iv) re-tightening the sprocket fasteners FS;

(v) removing the tool T (alternatively, the tool T can be removed before the fasteners FS are re-tightened).

Figure 5:
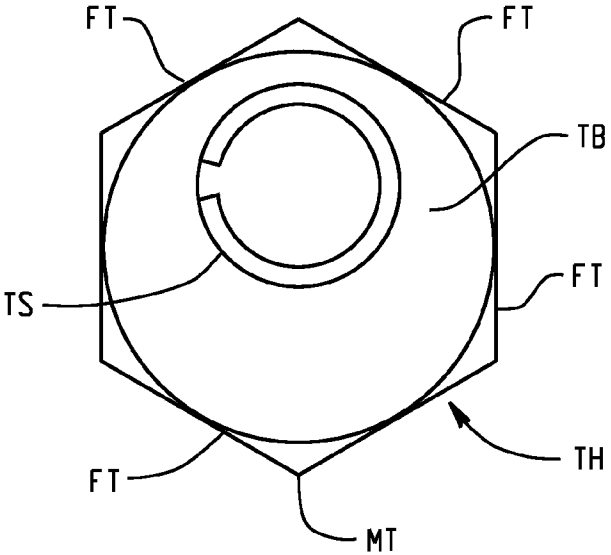
FIG. 5 is a view of the tool as taken along view line 5-5.
Figure 4:
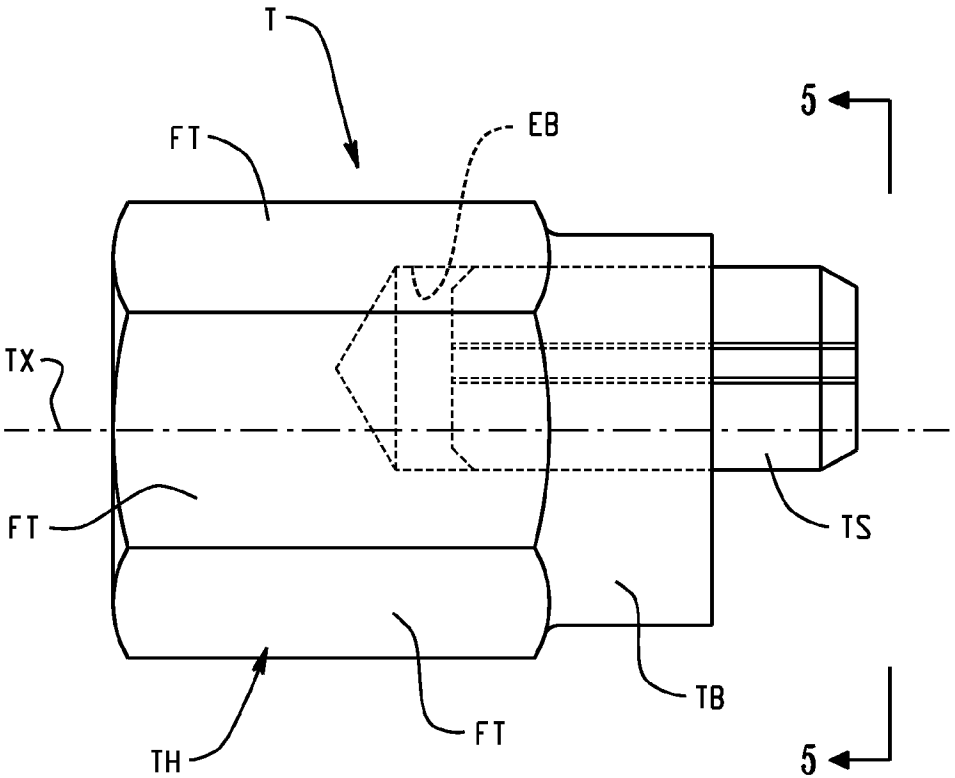
FIG. 4 is a side view of an adjustment tool formed in accordance with the present invention.

Referring now to FIGS. 4 and 5, one preferred adjustment tool T formed in accordance with the present invention is shown. The tool T comprises a cylindrical base TB defined from steel or other high-strength metal. The cylindrical base TB is defined about a central axis TX and dimensioned to be received in one of the circular tool-receiving locations Q1,Q2 with minimal clearance while still allowing the tool to rotate in the tool-receiving location. The base includes or defines a driving head TH adapted to be engaged by a wrench or other driver. As shown, the driving head comprises a plurality of flats FT that define a hexagonal driving head TH that is adapted to be engaged by a conventional socket-type ratchet wrench or other wrench. The tool T further comprises a stud TS that projects axially outward from the cylindrical base TB in a direction opposite the driving head TH. The stud TS extends parallel to but is eccentrically located relative to the central axis TX of the cylindrical base TB. The tool stud TS is dimensioned to be received between the lateral sides La,Lb of either one of the adjustment slots L1,L2 of the sprocket assembly A with a small clearance the allows the stud TS to rotate and slide in the adjustment slot L1,L2. In one preferred embodiment, the tool T is manufactured using hexagonal steel bar stock that is machined to define the base TB, so that the remaining unmachined portion of the hexagonal bar stock defines the driving head TH with six flats FT. An eccentric axially extending blind bore EB is defined into the base TB and typically also extends axially into the driving head TH as shown. A metal pin, dowel or other stud is press-fit into the eccentric bore EB and projects outwardly therefrom so as to define the eccentric stud TS. In one preferred embodiment, as shown herein, a split or spiral rolled steel spring pin is press-fit into the eccentric bore EB to define the eccentric stud TS. Use of a spring pin eliminates the need to hold close tolerances on the eccentric bore EB diameter, i.e., the spring pin adjusts to accommodate variations in the diameter of the bore EB so as to be received with a tight friction fit for a variety of bore diameters within a defined range.

Figure 2:
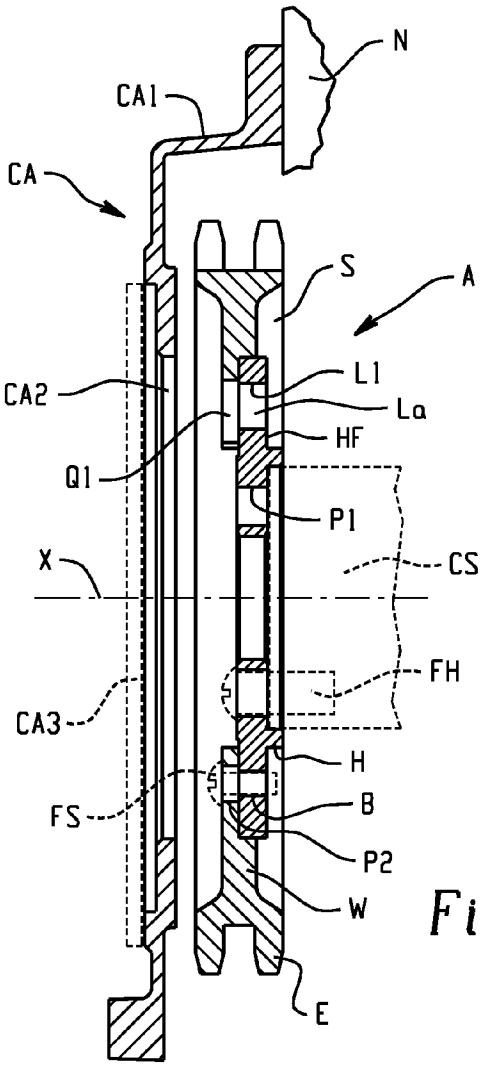
FIG. 2 is a sectional view as taken along line 2-2 of FIG. 1, and shows a related timing chain cover assembly.

With reference again to FIGS. 1-3, use of the adjustable camshaft sprocket assembly A is described in further detail. As shown in FIG. 2, in a typical installation, the hub H of the adjustable sprocket assembly A is connected to a camshaft CS, and the adjustable sprocket assembly A is covered by a timing chain cover assembly CA that is secured to the engine block N. The cover assembly CA comprises a main cover CA1 defining an access opening CA2. A lid CA3 (shown schematically) is releasably secured by fasteners to the cover CA1 to close the access opening CA2 (and, in some cases, also to retain and provide end-play adjustment for the camshaft CS).

Figure 3:
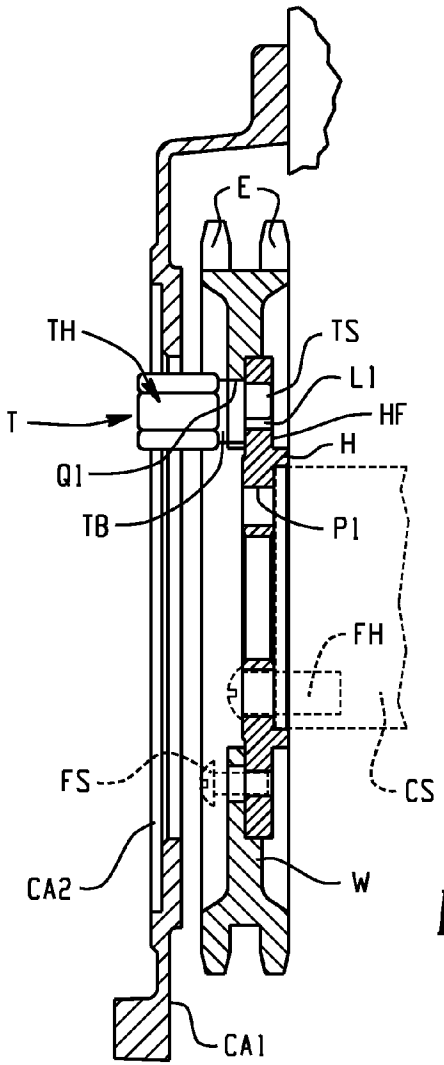
FIG. 3 is a section view that is similar to FIG. 2, except that it shows the lid of the timing chain cover assembly removed and shows an adjustable tool formed in accordance with the present invention operatively engaged with the sprocket assembly to adjust same.

When the lid CA3 is removed, a user is able to work through the access opening CA2 of the cover CA1 to loosen the sprocket fasteners FS and also to engage the adjustment tool T with the sprocket assembly A as shown in FIG. 3. In this regard, it should be noted that the sprocket fasteners FS and tool-receiving locations Q1,Q2 are encompassed by the cover access opening CA2 so that removal of the main cover CA1 from the engine block N is not required to access the sprocket fasteners FS or to insert the tool T into either tool-receiving location Q1,Q2. Also, as shown in FIG. 3, when the tool T is engaged with a tool-receiving location Q1 or Q2, the driving head TH of the tool T preferably projects outwardly through the cover access opening CA2 and/or the access opening CA2 is located so as not to prevent the driving head TH of the tool T from being engaged by a socket wrench or other driver.

With continuing reference to FIG. 3, when the tool T is operatively engaged with the adjustable sprocket assembly A, the cylindrical base TB is closely received in one of the circular tool-receiving locations Q1,Q2 and the cylindrical base TB of the tool abuts the hub flange HF, while the eccentric stud TS of the tool is received in the respective underlying adjustment slot L1,L2 of the hub flange HF. As noted above, the eccentric stud TS is closely received between the opposite lateral sides La,Lb of the underlying adjustment slot L1,L2. Those of ordinary skill in the art will recognize that, when the sprocket fasteners FS are loosened, rotation of the driving head TH of the tool T with a socket wrench or other driver will result in rotation of the tool base TB in the tool-receiving location Q1,Q2 which will, in turn, result in eccentric movement of the tool stud TS. Because the eccentric stud TS is closely received between the lateral sides La,Lb of an adjustment slot L1,L2, (L1 as shown herein), the eccentric movement of the stud TS will cause rotation of the hub H about the axis of rotation X relative to the sprocket body S (the sprocket body S is typically restrained against rotational movement owing to its driving connection via chain or belt to the crankshaft sprocket and related engine components, although some movement of the sprocket body S is possible). The ovalized or elongated nature of the slots L1,L2 is required to allow sliding movement of the eccentric stud TS in the slot when the hub H rotates relative to the sprocket body S. As noted above, when the hub H and sprocket body S are arranged in the desired relative angular position relative to each other using the tool, all of the sprocket fasteners FS are re-tightened to immovably clamp the sprocket body S to the hub flange HF again and the tool T is removed from the tool-receiving location Q1 or Q2, unless the tool was already removed before the fasteners FS are re-tightened as is contemplated. It should be noted that the adjustable camshaft sprocket and tool as set forth herein allow for the timing adjustment to be made with the valve springs or other loads in place.

The web W of the sprocket body S and/or the hub flange HF include index marks M that provide a visual indication of the relative angular position between the hub H and sprocket body S which also indicates the advancement or retardation of the camshaft timing.

In an alternative embodiment, the tapped bores B are defined in the sprocket web W, in which case the elongated slots P2 are defined in the hub flange HF.

Figure 6:
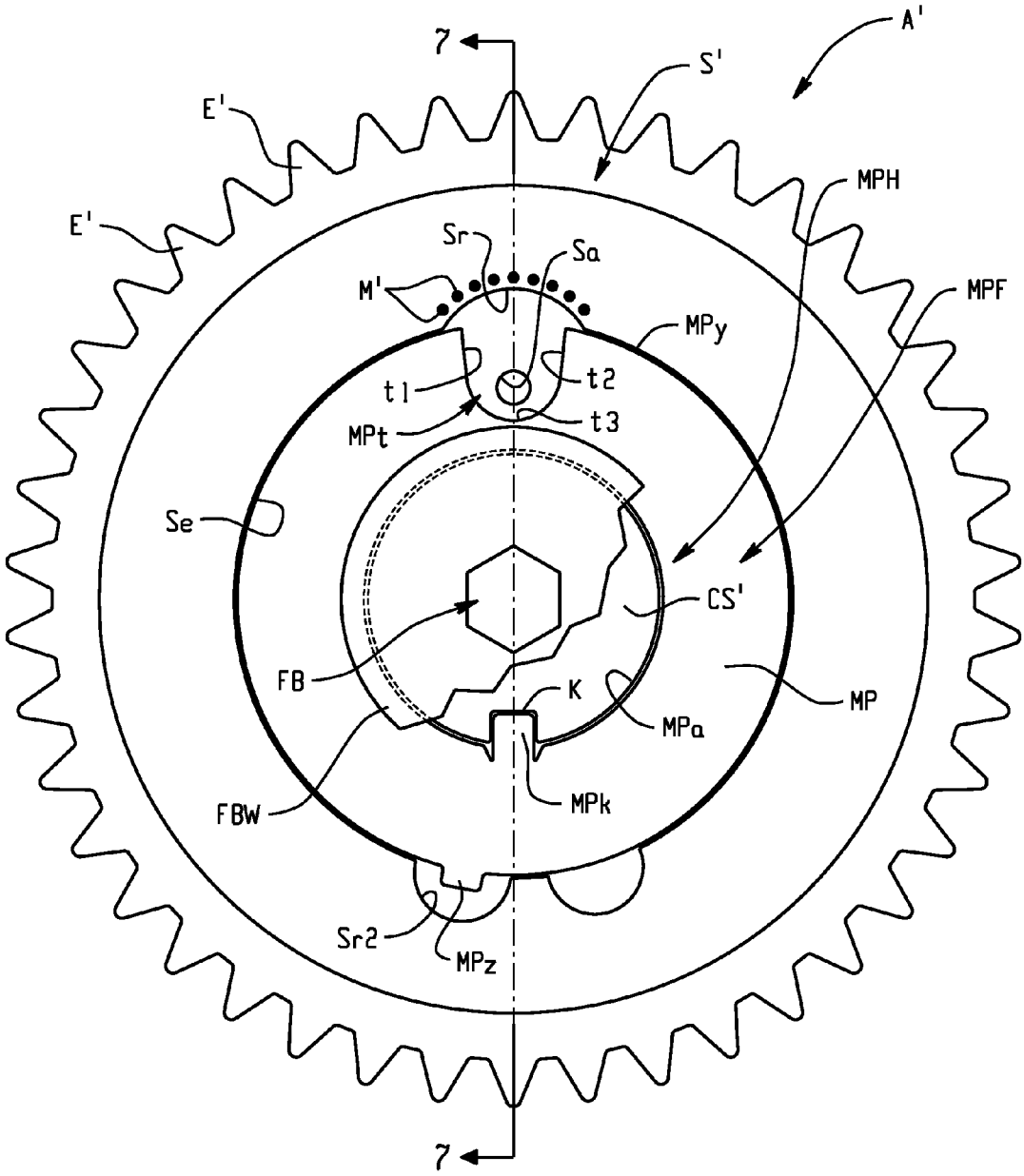
FIG. 6 is a front view of an adjustable sprocket assembly formed in accordance with an alternative embodiment of the present invention.
Figure 8:
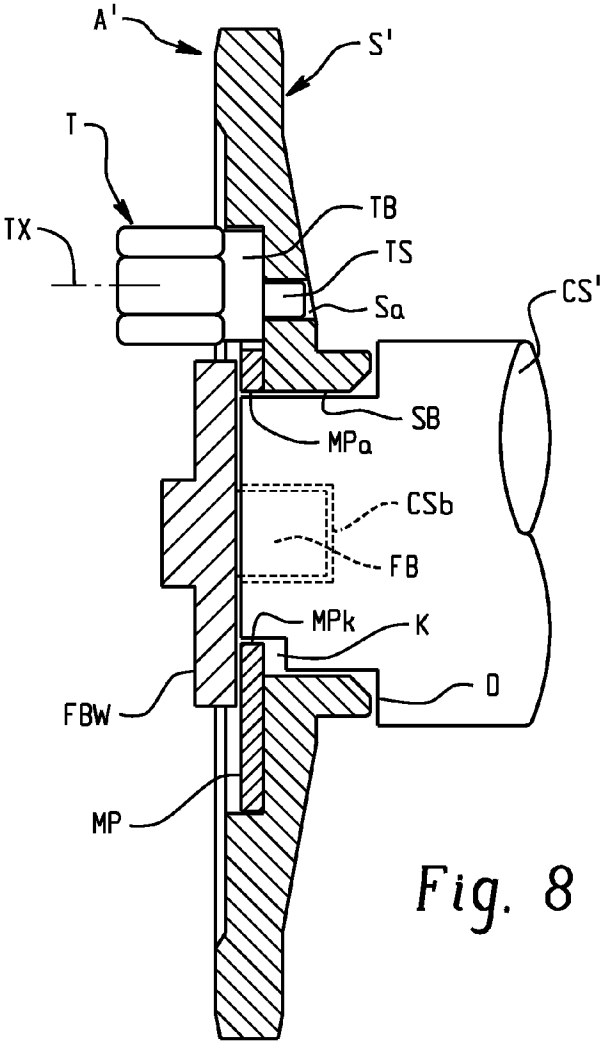
FIG. 8 is similar to FIG. 7, except that the camshaft is not sectioned, and it shows the adjustment tool of FIGS. 4 and 5 operatively engaged with the sprocket assembly in order to adjust same in accordance with the present invention.
Figure 7:
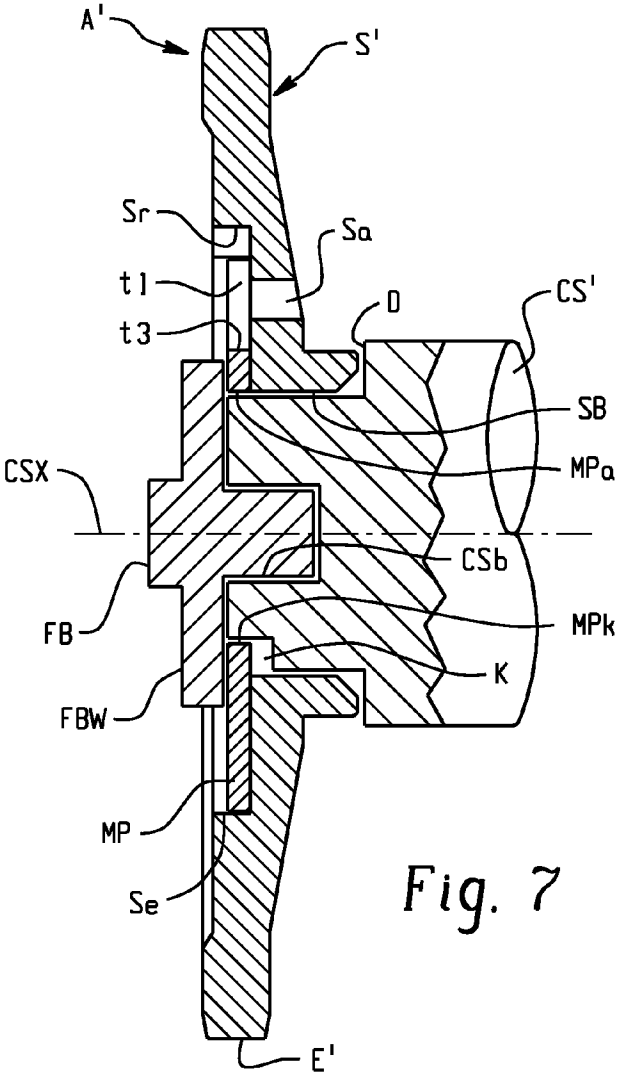
FIG. 7 is a sectional view as taken along line 7-7 of FIG. 6.

In a further alternative embodiment, the tool-receiving openings/apertures Q1,Q2 are non-circular and elongated, and the stud-receiving openings L1,L2 are circular (see e.g., FIGS. 6-8).

The term "circular" as used herein is intended to encompass a polygonal shaped (e.g., hexagonal or octagonal or other shaped) opening that allows rotation of the tool body TB about its tool axis TX but that prevents movement of the tool axis TX.

The sprocket S, hub H and tool T are preferably defined from metal, as described, but other non-metallic materials, such as those comprising polymeric compounds can also be used.

FIG. 6 is a front view of an adjustable sprocket assembly A' formed in accordance with an alternative embodiment of the present invention. The sprocket assembly A' can be substituted for the sprocket A in accordance with the present invention, and the adjustment tool T of FIGS. 4 and 5 is also usable to adjust the sprocket assembly A'. FIG. 7 is a sectional view as taken along line 7-7 of FIG. 6. FIG. 8 is similar to FIG. 7, but shows the adjustment tool T of FIGS. 4 and 5 operatively engaged with the sprocket assembly in order to adjust same in accordance with the present invention.

As shown in FIGS. 6-8, the sprocket assembly A' comprises a metal sprocket body S' including a plurality of teeth E' that are engaged by an associated drive chain or belt (not shown) that is driven by a drive sprocket (not shown), e.g., a crankshaft sprocket. As described herein, sprocket body S' is selectively fixedly secured to a camshaft CS' so that rotation of the sprocket body causes rotation of the camshaft. In accordance with the present invention, the angular mounting position of the sprocket body S' as fixed to the camshaft CS' is selectively adjustable + or – a certain number of degrees, e.g., 14 degrees, to control the timing of the intake and/or exhaust valves of an internal combustion engine. As shown the sprocket body S' includes a central bore SB that is received on the camshaft CS'. The sprocket body S' is inserted onto the camshaft fully so that it abuts a shoulder D or other portion of the camshaft when fully installed in terms of its axial location. It should be noted that the sprocket body S' is rotatable relative to the camshaft CS' until fixed in a select angular position on the camshaft as described below.

The adjustable sprocket assembly A' further comprises a hub or mounting washer or mounting plate MP typically also defined from metal that is received on the camshaft CS' outboard of and in abutment with the sprocket body S'. The mounting plate MP includes an inner or central hub portion MPH defining a central aperture MPa that closely receives the camshaft CS', and the sprocket body S' includes a recess Se that closely receives an outer or flange portion MPF of the mounting plate MP. The mounting plate MP further comprises a tab or key MPk that projects radially into the aperture MPa from the periphery of the aperture MPa, and the camshaft includes a corresponding keyway K that slidably receives the mounting plate key MPk with a close sliding fit that prevents rotation of the mounting plate MP relative to the camshaft CS. Those of ordinary skill in the art will recognize that the mounting plate MP can also be referred to as a hub.

The adjustable sprocket assembly A' includes means for selectively fixedly securing the sprocket body S' to the camshaft CS' in a manner that prevents any relative axial or angular movement between the sprocket body and camshaft. In the illustrated embodiment, the camshaft CS' includes an axially extending centrally located tapped bore CSb that receives a threaded mounting bolt or like fastener FB that includes a driving head. As shown, the mounting bolt FB includes an integral clamping flange FBW that is radially enlarged sufficiently so that a the clamping flange FBW contacts the mounting plate MP and clamps the mounting plate MP against the sprocket body S' to selectively engage the mounting plate to the sprocket body, and that clamps the sprocket body S' against the shoulder D or other location of the camshaft CS' when the mounting bolt FB is advanced into the corresponding camshaft bore CSb. The illustrated clamping flange FBW is integral to the mounting bolt FB, but the clamping flange can also be provided by a separate radially enlarged washer or other like structure through which the mounting bolt FB extends. Also, the illustrated embodiment uses a single mounting bolt FB that is coaxial with the axis of rotation CSX of the camshaft, but an alternative embodiment uses two or more mounting bolts threaded in respective camshaft bores located radially outward from and arranged at intervals around the camshaft axis of rotation CSX.

The mounting plate MP includes an adjustment tool aperture or opening MPt defined therethrough that includes side walls t1, t2 that receive the cylindrical base TB of the adjustment tool T closely therebetween. When the tool T is inserted in the adjustment tool opening MPt, the projecting stud TS of the tool is received in a stud-receiving bore Sa defined in the sprocket body S' and underlying the adjustment tool opening MPt. The stud TS can rotate in the stud-receiving bore Sa but cannot otherwise move. As such, the axis TX of the tool T will move eccentrically about the stud TS when the adjustment tool is rotated in the mounting plate opening MPt, causing the cylindrical body TB of the tool to bear against the opening side walls t1 or t2, depending upon the direction in which the adjustment tool is rotated, resulting in clockwise or counterclockwise movement of the mounting plate MP and camshaft CS' keyed thereto relative to the sprocket body S'. For this embodiment A', the mounting plate MP will move in a direction corresponding to the direction in which the tool T is rotated. The sprocket body S' defines a recess Sr that surrounds the stud-receiving bore Sa to accommodate positioning and the eccentric movement of the tool body TB relative to the sprocket body S' during the adjustment process. The tool receiving opening MPt of the mounting plate is conformed and dimensioned so allow for bi-directional relative sliding movement between the tool body TB and the mounting plate MP during the adjustment process. In the illustrated embodiment, the adjustment tool opening MPt opens through the periphery MPy of the mounting plate and is elongated such that when the mounting plate and sprocket body are located at a neutral (non-adjusted) position relative to each other (so that the tool stud TS is centered between the side walls t1,t2 of the tool opening MPt), a radial clearance is defined between the tool body TB and the inner end t3 of the adjustment tool opening MPt. Full rotation of the tool T in either direction will cause the tool body TB to pivot about the stud TS and move toward the inner wall t3 and close the clearance between the tool and the wall t3. Rotation of the tool T to a point where the tool contacts the inner wall t3 will prevent further adjustment beyond that point. As noted, the adjustment process using the tool T requires that the mounting bolt FB (or bolts) first be loosened to allow rotation of the mounting plate MP and camshaft CS' relative to the sprocket body S', and the mounting bolt(s) is then tightened to immovably fix the angular position of the mounting plate MP and camshaft CS' relative to the sprocket body S' by the axial clamping action of the mounting bolt flange FBW. Alternatively, the adjustment tool opening MPt can be circular or otherwise shaped (e.g., polygonal) to allow only rotational (not sliding) movement of the tool body TB about its axis TX therein, in which case the stud-receiving bore Sa is elongated to permit sliding movement of the tool stud TS therein.

The sprocket body S' and/or the mounting plate MP includes apertures, cut-outs and other voids, lugs, etc. for balancing the rotation, e.g., to balance the presence of the adjustment tool opening MPt and stud-receiving bore Sa and surrounding recess portion Sr of the sprocket body S'. As shown, the sprocket body S' includes a balancing recess Sr2 defined therein and the mounting plate MP includes a tab MPz that is located in the recess Sr2. In such case, the tab MPz acts as a safety stop in that rotation of the mounting plate MP relative to the sprocket body S' is limited by the circumferential extent of the recess Sr2 when angular movement of the mounting plate MP causes the tab MPz to move circumferentially into contact with the sprocket body S'.

The sprocket body S' and/or mounting plate MP include index marks M' that allow a user to assess the relative angular relationship between the sprocket body and mounting plate. The tool T can include an index mark or feature MT that, when aligned with one of the marks M' of the sprocket body or mounting plate, indicates the angular adjustment status. Like the adjustable camshaft sprocket assembly A, the adjustable camshaft sprocket assembly A' and tool T as disclosed herein allow for the timing adjustment to be made with the valve springs or other loads in place.

The invention has been described with reference to preferred embodiments. Modifications and alterations will occur to those of ordinary skill in the art to which the invention pertains, and it is intended that the invention as defined by the following claims be construed as encompassing all such modifications and alterations.

The invention claimed is:

1. An adjustable camshaft sprocket assembly comprising:

a hub adapted to be secured to an associated camshaft, said hub comprising a flange;

a sprocket body selectively engaged with said hub flange using at least one fastener, wherein said sprocket body is selectively angularly adjustable relative to said hub flange when said at least one fastener is loosened and said sprocket body is angularly fixed relative to said hub flange when said at least one fastener is tightened;

a stud-receiving opening defined in one of said hub flange and said sprocket body, and a tool-receiving opening defined in the other of said hub flange and said sprocket body, said tool-receiving opening aligned with said stud-receiving opening and adapted to receive a body portion of an associated adjustment tool, and said stud-receiving opening adapted to receive an eccentric stud of the associated adjustment tool, wherein either the stud-receiving opening or the tool-receiving opening is elongated to allow relative sliding movement of the associated adjustment tool therein, wherein rotation of the associated adjustment tool when its body is located in the tool-receiving opening and its eccentric stud is located in the stud-receiving opening causes relative angular movement between said hub and said sprocket body when said at least one fastener is loosened.

2. The adjustable camshaft sprocket assembly as set forth in claim 1, wherein said stud-receiving opening is defined in said hub flange and said tool-receiving opening is defined in said sprocket body.

3. The adjustable camshaft sprocket assembly as set forth in claim 2, wherein said stud-receiving opening is elongated so as to define an adjustment slot.

4. The adjustable camshaft sprocket assembly as set forth in claim 3, wherein said tool-receiving opening is circular.

5. The adjustable camshaft sprocket assembly as set forth in claim 1, wherein said tool-receiving opening is elongated so as to allow the body portion of the associated tool to pivot about the eccentric stud portion of the associate tool when the associated tool is rotation in said tool-receiving opening.

6. The adjustable camshaft sprocket assembly as set forth in claim 5, wherein said stud-receiving opening is defined in said sprocket body and said tool-receiving opening is defined in said hub flange.

7. The adjustable camshaft sprocket assembly as set forth in claim 1, wherein said stud-receiving opening is defined in the sprocket body and is elongated so as to define an adjustment slot.

8. The adjustable camshaft sprocket assembly as set forth in claim 7, wherein said tool-receiving opening is circular and defined in the hub flange.

9. The adjustable camshaft sprocket assembly as set forth in claim 1, wherein said hub is adapted to be non-rotatably keyed to said camshaft.

10. The adjustable camshaft sprocket assembly as set forth in claim 9, wherein the at least one fastener non-rotatably clamps the hub flange to the sprocket body and also non-rotatably clamps the sprocket body to the associated camshaft when tightened.

11. The adjustable camshaft sprocket assembly as set forth in claim 10, wherein the at least one fastener comprises a radially enlarged flange, wherein when said at least one fastener is tightened, the radially enlarged flange of the at least one fastener exerts an axial clamping force on said hub flange which, in turn, exerts an axial clamping force on the sprocket body.

12. The adjustable camshaft sprocket assembly as set forth in claim 1, wherein said hub is adapted to be non-rotatably bolted to the associated camshaft.

13. The adjustable camshaft sprocket assembly as set forth in claim 12, wherein the sprocket body comprises a web defining a plurality of elongated slots and said hub flange comprises a plurality of tapped bores aligned respectively with the elongated slots, wherein said at least one fastener comprises a plurality of fasteners inserted respectively through the elongated slots and threaded into the tapped bores, wherein said plurality of fasteners clamp said web of said sprocket body to said hub flange when tightened.

14. The adjustable camshaft sprocket assembly as set forth in claim 12, wherein the sprocket body comprises a web defining a plurality of tapped bores and said hub flange comprises a plurality of elongated slots aligned respectively with the tapped bores, wherein said at least one fastener comprises a plurality of fasteners inserted respectively through the elongated slots and threaded into the tapped bores, wherein said plurality of fasteners clamp said web of said sprocket body to said hub flange when tightened.

15. An adjustable camshaft sprocket assembly comprising:

a hub adapted to be secured to an associated camshaft, said hub comprising a flange;

a sprocket body secured to said hub flange using at least one fastener, wherein said sprocket body is selectively angularly adjustable relative to said hub flange when said at least one fastener is loosened and wherein said sprocket body is immovably fixed to said hub flange when said at least one fastener is tightened;

a stud-receiving slot defined in the hub flange adapted to receive a projecting eccentric stud of an associated adjustment tool;

a tool-receiving opening defined in the sprocket body and aligned with said stud-receiving slot and adapted to receive a body portion of the associated adjustment tool;

wherein rotation of the associated adjustment tool body in the tool-receiving opening with the associated adjustment tool eccentric stud located in the stud-receiving slot causes relative angular movement between said hub and said sprocket body when said at least one fastener is loosened.

* * * * *